US009874011B2

(12) United States Patent
Oliveira et al.

(10) Patent No.: US 9,874,011 B2
(45) **Date of Patent: *Jan. 23, 2018**

(54) MODULAR PANEL SYSTEM

(71) Applicant: Freeman Capital Company, Las Vegas, NV (US)

(72) Inventors: Jorge Oliveira, Rutherford, NJ (US); Carl Edward Crow, Grand Prairie, TX (US); Michael Hanson, Mesquite, TX (US)

(73) Assignee: Freeman Capital Company, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/067,982

(22) Filed: Mar. 11, 2016

(65) Prior Publication Data

US 2016/0194870 A1 Jul. 7, 2016

Related U.S. Application Data

(63) Continuation of application No. 13/772,015, filed on Feb. 20, 2013, now Pat. No. 9,315,986.

(51) Int. Cl.
*E04B 2/74* (2006.01)
*E04B 2/72* (2006.01)
(Continued)

(52) U.S. Cl.
CPC ..... *E04B 2/7407* (2013.01); *E04B 1/4107* (2013.01); *E04B 2/72* (2013.01);
(Continued)

(58) Field of Classification Search
CPC ... A47F 10/00; E04B 2/74; E04B 1/38; E04B 1/4107; E04B 1/4178; E04B 1/4135; E04B 1/4128; E04B 2/7407; E04B 2/789; E04B 2/761; E04B 2/76; E04B 2/72; E04B 2/7422; E04B 2002/749; E04B 2/7836; E04B 2/765; E04B 2/7425; Y10T 403/70
(Continued)

(56) References Cited

U.S. PATENT DOCUMENTS 3,592,288 A 7/1971 Walter
3,592,493 A 7/1971 Goose
(Continued)

*Primary Examiner* — Phi A
*Assistant Examiner* — Omar Hijaz
(74) *Attorney, Agent, or Firm* — Gardere Wynne Sewell LLP

(57) ABSTRACT

A modular panel system including a plurality of posts where each post includes a front face, a rear face, and opposed lateral faces. A central channel is formed in the front face where the central channel has a linking opening, a first ledge and a second ledge. Cutouts are formed in the ledges. The rear face includes a panel receiving channel that receives an edge of a panel. A linking element is configured to be secured in the linking opening. The head of the linking element is sized to fit within the first and the second cutouts and be secured by the first and second ledges to couple the first post to the second post. The lateral faces of the coupled posts together form a first side central channel and a first side central channel cutout that is configured to receive a second linking element to couple a third post to the coupled first and second posts.

17 Claims, 16 Drawing Sheets

(51) Int. Cl.
*E04B 1/41* (2006.01)
*E04B 2/76* (2006.01)
*E04B 2/78* (2006.01)

(52) U.S. Cl.
CPC ..... *E04B 2/7422* (2013.01); *E04B 2/76* (2013.01); *E04B 2/761* (2013.01); *E04B 2/789* (2013.01); *E04B 1/4128* (2013.01); *E04B 1/4135* (2013.01); *E04B 1/4178* (2013.01); *E04B 2/7425* (2013.01); *E04B 2/765* (2013.01); *E04B 2/7836* (2013.01); *E04B 2002/749* (2013.01); *Y10T 29/49826* (2015.01); *Y10T 403/70* (2015.01)

(58) Field of Classification Search
USPC ..... 52/710, 711
See application file for complete search history.

(56) References Cited

U.S. PATENT DOCUMENTS 3,901,612 A 8/1975 Canin
4,100,709 A 7/1978 Good
4,490,064 A 12/1984 Ducharme
4,567,698 A * 2/1986 Morrison ..... A47B 83/001 160/135
4,644,706 A 2/1987 Stafford et al.
4,653,652 A 3/1987 Avati
4,689,929 A 9/1987 Wright
4,878,640 A * 11/1989 Fricker ..... E04B 1/4107 248/297.21
5,069,263 A 12/1991 Edwards
5,092,087 A 3/1992 Kane et al.
5,117,599 A * 6/1992 Voss ..... E04B 2/7425 52/238.1
5,155,960 A 10/1992 Shaanan
5,211,502 A 5/1993 Upham-Hill
5,335,470 A * 8/1994 Alvarez ..... E04B 7/04 249/213
5,561,960 A 10/1996 Minnick et al.
5,596,843 A 1/1997 Watson
5,682,719 A * 11/1997 Huang ..... A47G 5/00 52/239
5,687,859 A 11/1997 Miller
5,715,633 A 2/1998 Raz et al.
5,833,332 A 11/1998 Marshall et al.
5,987,844 A * 11/1999 Reid ..... E06B 3/5892 52/208
6,029,831 A 2/2000 Miller
6,079,174 A 6/2000 Williams et al.
6,125,600 A * 10/2000 Bastian ..... E04B 2/7422 52/220.7
6,223,917 B1 5/2001 Bruder
6,305,455 B1 10/2001 Wendel
6,442,909 B2 9/2002 Waalkes et al.
6,619,003 B2 * 9/2003 Von Arx ..... G09F 15/0012 101/127.1
6,883,277 B2 4/2005 Wiechecki et al.
6,928,776 B2 * 8/2005 Hornung ..... E06B 3/24 156/107
7,891,147 B2 2/2011 Bruder
8,015,736 B2 9/2011 Frey
8,015,767 B2 9/2011 Glick et al.
8,132,791 B2 3/2012 Stucker
8,196,326 B2 6/2012 Frey
8,240,072 B2 8/2012 Frey
8,371,076 B2 2/2013 Jones et al.
8,528,294 B2 9/2013 Vanker et al.
8,572,928 B2 11/2013 Bruder
8,956,071 B2 2/2015 Frey
8,959,859 B2 2/2015 Haan et al.
2002/0129574 A1 9/2002 Newhouse et al.
2003/0089057 A1 * 5/2003 Wiechecki ..... E04B 2/7427 52/238.1
2004/0190987 A1 * 9/2004 Yang ..... E04B 2/7425 403/348
2006/0010792 A1 * 1/2006 Biggers ..... E06B 9/02 52/202
2007/0204523 A1 9/2007 Chamberlain
2007/0234659 A1 * 10/2007 Bruder ..... E04B 2/7407 52/239
2007/0240371 A1 10/2007 Clifford et al.
2011/0265361 A1 11/2011 Frey
2012/0304515 A1 12/2012 Ceurvels
2014/0115982 A1 * 5/2014 Abdul Lathief ..... E06B 3/5821 52/208
2014/0208673 A1 * 7/2014 Huang ..... E04B 2/7401 52/234
2014/0294492 A1 10/2014 Frey
2015/0047283 A1 2/2015 Frey

* cited by examiner

MODULAR PANEL SYSTEM

CROSS REFERENCE TO RELATED APPLICATIONS

This application is a continuation of U.S. patent application Ser. No. 13/772,015, entitled "Panel Support," filed Feb. 20, 2013, now pending and incorporated herein by reference in its entirety.

TECHNICAL FIELD

This disclosure relates to a support for a panel and, in particular, to a support that is configured to interlock with one or more adjacent supports.

BACKGROUND OF THE DISCLOSURE

Panel supports are often used in large areas, such as conference centers and office buildings, to segregate large areas into smaller, separate areas. The panel supports may be linked together to create segregated areas and may hold panels that act as walls between the segregated areas. A large area may then be used as if it were segregated by permanent walls that are part of the permanent structure of a building enclosing the large area. A grouping of linked panel supports may be temporarily installed in the large area or may remain in place permanently in the large area.

Constructing panel supports, placing panels within the panel supports and attaching adjacent panel supports together to create the layout desired for a particular event, in addition to disengaging adjacent panel supports, removing the panels and disassembling the panel supports after the event, can be very time consuming and labor intensive. Panel supports may include additional features besides those necessary to hold the panel, such as, for example, extrusions with slots to hold accessories, that must be separately secured to the panel support. The assembly of panel supports and additional features often requires the use of tools and a skilled labor force that has been trained to perform such tasks. Thus, costs associated with the skilled labor required to assembly and disassemble panel supports for an event can be very high.

In addition, in some instances, such as conferences, temporary exhibits, temporary shows and other temporary events, multiple events are scheduled back-to-back in a single venue. In such cases, the panel supports used for a particular event must be assembled and/or disassembled quickly, which may further increase the labor costs associated with preparing for the event.

In view of the foregoing, minimizing the skill, training and time required to assemble and disassemble the panel support is important in reducing costs associated with an event.

SUMMARY

A structure, system and method are described that reduce the skill, training and time required to assemble and disassemble a panel support. In a first aspect, a structure includes a central channel that includes a first ledge extending from a first side of the central channel and a second ledge extending from a second side of the central channel; a first cutout in the first ledge; a second cutout in the second ledge that is aligned with the first cutout; a first side channel that includes an outer wall with a first outer wall cutout aligned with the first cutout; and a second side channel that includes an outer wall with a second outer wall cutout aligned with the second cutout.

In another aspect, a system for holding a panel includes a first post structure with a front side and a back side, wherein the front side includes a central channel with a pair of cutouts and the backside includes a back side channel and an accessory opening; a second post structure that also includes a front side and a back side, wherein the front side includes a central channel with a pair of cutouts and the backside includes a back side channel and an accessory opening; a base with a first lateral end of the base that is connected to the back side of the first post structure and a second lateral end that is connected to the back side of the second post structure; and a connector with a first lateral end of the connector that is connected to the back side of the first post structure and a second lateral end of the connector that is connected to the back side of the second post structure.

In another aspect, a method of assembling a display unit includes providing a first post structure and a second post structure, wherein the first post structure and the second post structure include a front side and a back side and wherein the front side includes a central channel with a first cutout in a first side of the central channel and a second cutout in a second side of the central channel, and wherein the first cutout is aligned with the second cutout. The front side of the first post structure includes a linking opening in the central channel and a linking element connected to the linking opening; locating a head of the linking element of the first post structure between the first cutout and the second cutout of the second post structure and within the central channel of the second post structure; and misaligning the head of the linking element of the first post structure with the first and second cutouts of the second post structure.

In another aspect, a system includes a base that has a base channel, a slide bolt and a post structure connected to a lateral end of the base. The slide bolt includes a first body member with a first portion having a first cross-sectional shape and a second portion having a second cross-sectional shape, wherein an area of the first cross-sectional shape is larger than an area of the second cross-sectional shape and wherein the first portion is shaped to fit within the base channel of the base. The slide bolt also includes a second body member connected to the first portion of the first body member, wherein the second body member is configured to be positioned generally perpendicularly to the base channel when the first body member is located in the base channel. The post structure also includes an opening shaped to receive the second portion of the slide bolt.

In yet another aspect, a linking structure includes a central channel, wherein the central channel includes a first cutout in a first side of the central channel and a second cutout in a second side of the central channel. The first cutout is aligned with the second cutout. The linking structure also includes a removable linking element disposed in the central channel, wherein the removable linking element is attached to the linking structure to form a male attachment structure and is removed from the linking structure to form a female attachment structure.

Other aspects, features, and advantages will become apparent from the following detailed description when taken in conjunction with the accompanying drawings, which are part of this disclosure and which illustrate, by way of example, principles of the inventions disclosed.

Other aspects, features, and advantages will become apparent from the following detailed description when taken in conjunction with the accompanying drawings, which are part of this disclosure and which illustrate, by way of example, principles of the inventions disclosed.

DESCRIPTION OF THE FIGURES

The accompanying drawings facilitate an understanding of the various embodiments.

DETAILED DESCRIPTION

Figure 1:
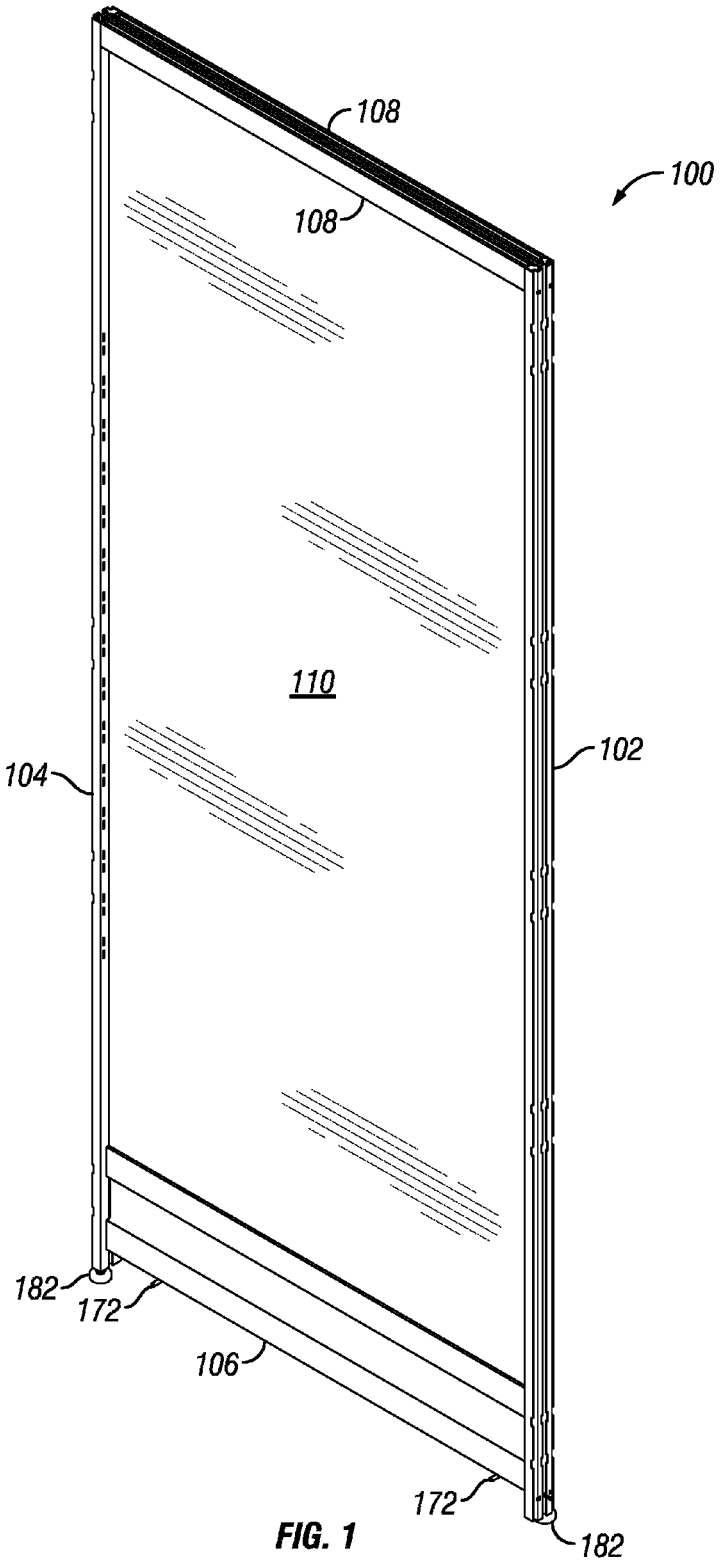
FIG. 1 is a perspective view of a panel support system.
Figure 2:
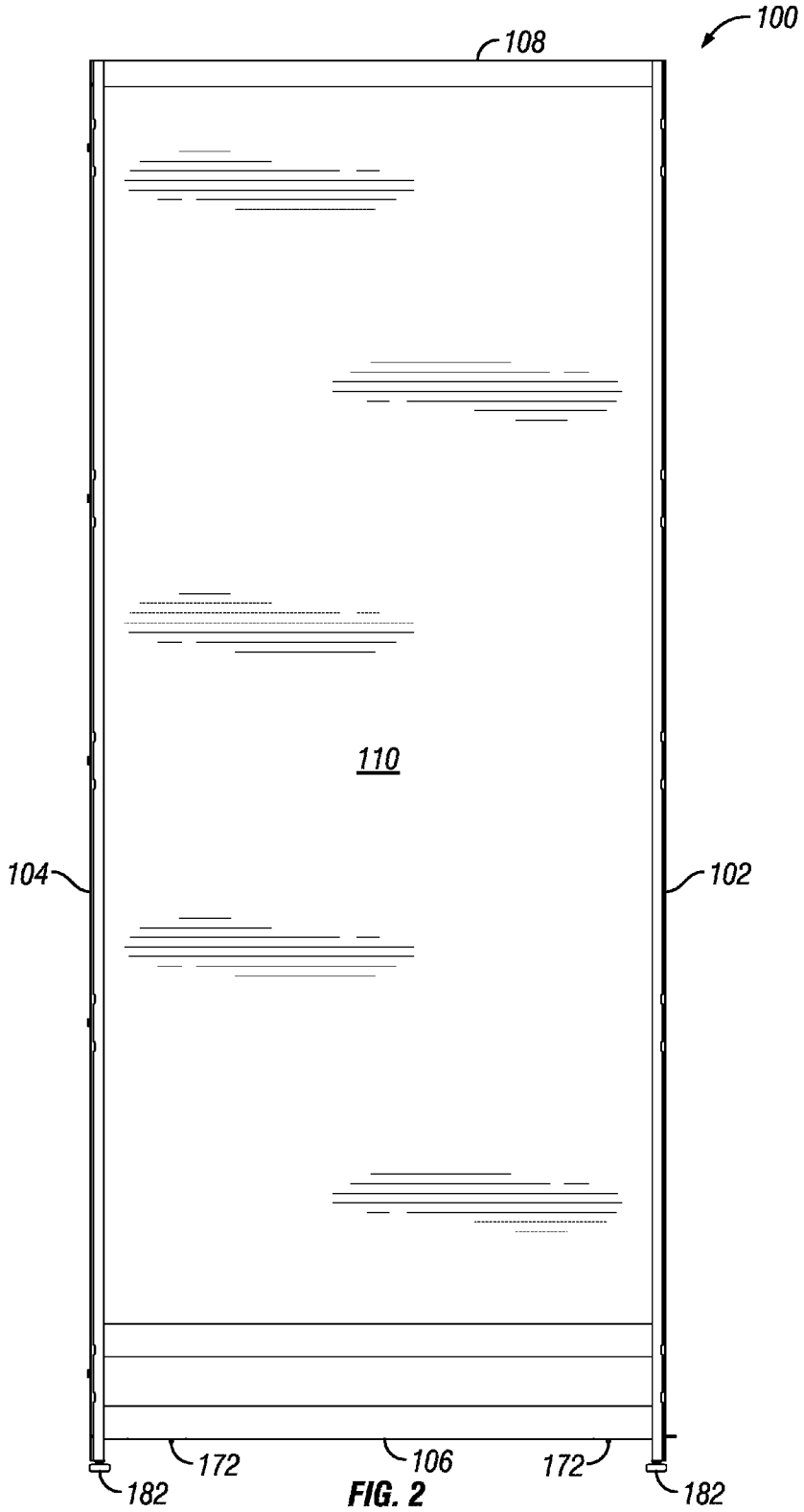
FIG. 2 is a front view of the panel support system of FIG. 1.

Referring to FIGS. 1-2, a system 100 is illustrated that includes a first post structure 102, a second post structure 104, a base 106 connected to the first and second post structures 102, 104, and first and second connectors 108 connected to the first and second post structures 102, 104, wherein one connector 108 is spaced from the other connector 108. A panel 110 is held in the system 100 between the first and second post structures 102, 104, the base 106, and the first and second connectors 108. As discussed in more detail below, the system 100 is configured to hold the panel 110 and to act as a portable wall. The system 100 is connectable to other systems 100 to create, for example, a booth in which the panels 110 act as walls surrounding and segregating an area of a venue, for example, a trade show floor, from other areas of the venue. The system allows 100 for easy installation of the panel 110 and quick connection of the system 100 to other systems 100. As will be explained in further detail below, the system 100 allows for reduced assembly time, lower manufacturing costs, the use of lower skilled, less expensive labor, and the use of lower cost, interchangeable parts, in addition to creating an aesthetically pleasing portable wall.

Figure 12:
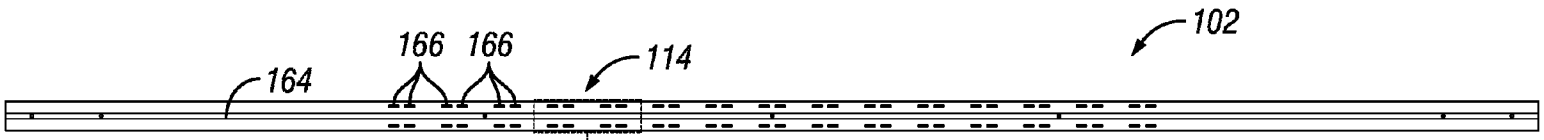
FIG. 12 is a back view of a back side of the post structure of FIG. 3.
Figure 13:
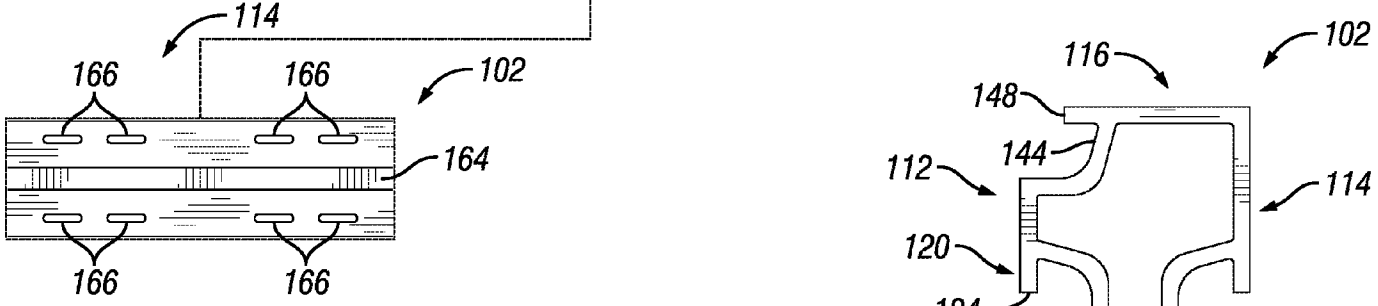
FIG. 13 is a magnified view of the post structure of FIG. 12.
Figure 14:
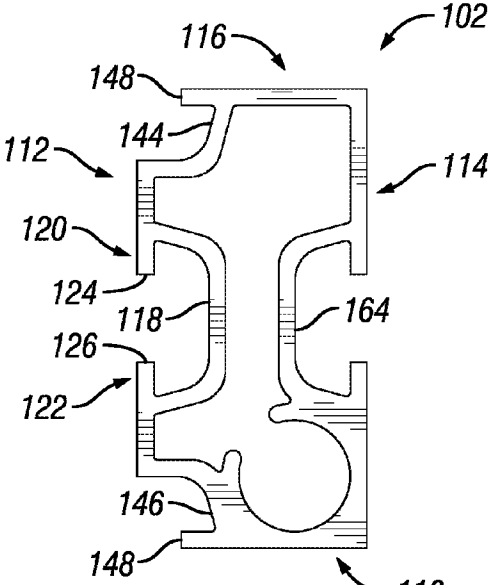
FIG. 14 is a magnified top view of the post structure of FIG. 3.

The post structure 102 of the system 100 is shown in more detail in FIGS. 3-14. The post structure 102 includes a front side 112 shown in FIGS. 3-6, two lateral sides 116 shown in FIGS. 7-10, and a back side 114 shown in FIGS. 12 and 13. Referring to the embodiments of FIG. 4, the front side 112 of the post structure 102 includes a central channel 118 that includes a first ledge 124 that extends from a first side 120 of the central channel 118 and a second ledge 126 that extends from a second side 122 of the central channel 118. FIG. 14 illustrates a top view of the post structure 102 showing an embodiment of the central channel 118, first ledge 124 and second ledge 126.

Figure 22:
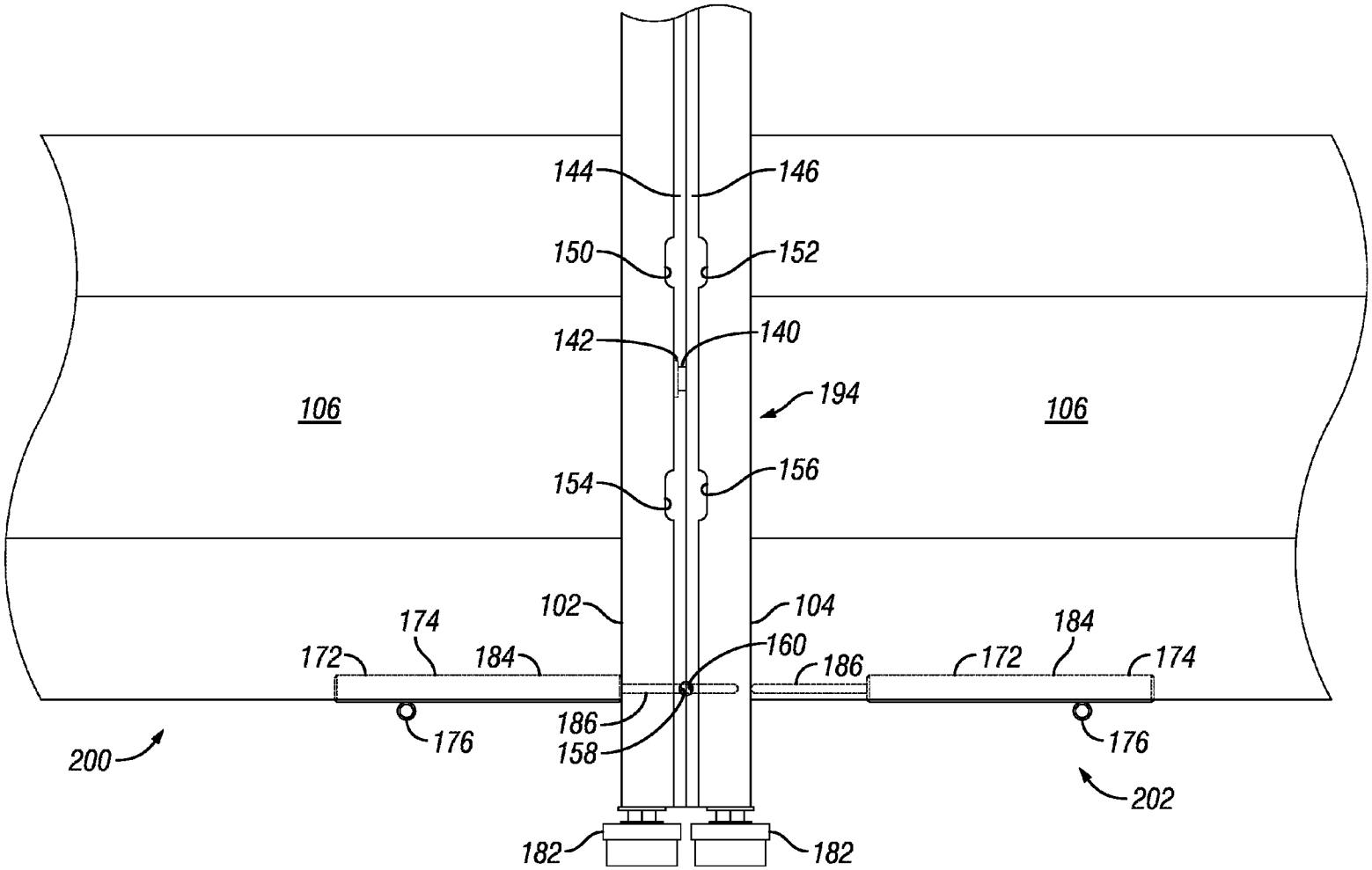
FIG. 22 is a magnified front view of a panel support assembly connected to another panel support assembly.

Referring again to FIG. 4, the first ledge 124 and the second ledge 126 include cutouts 128, 130, 132, 134 spaced along the length of the central channel 118 and oriented to allow for the removable attachment of the post structure 102 to an adjacent post structure 104, as shown in FIG. 22. The first ledge 124 includes a first cutout 128 and the second ledge 126 includes a second cutout 130 that is aligned with the first cutout 128. As will be described in more detail below, the first and second cutouts 128, 130 allow for the attachment of the post structure 102 to an adjacent post structure 104 by receiving a head 142 of a linking element 140 between the first and second cutouts 128, 130. Thus, the size and shape of the first and second cutouts 128, 130 corresponds to the size and shape of the head 142 of the linking element 140.

Figure 4:
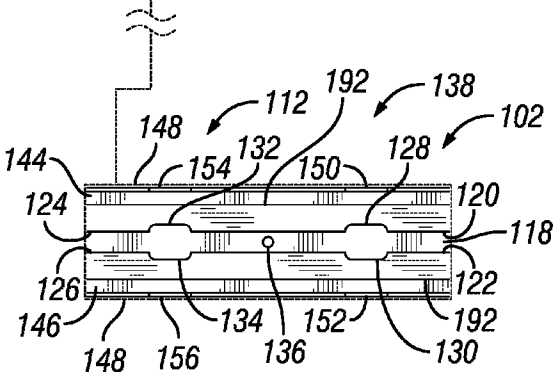
FIG. 4 is a magnified view of the post structure of FIG. 3.

As shown in the embodiment of FIG. 4, the first ledge 124 also includes a third cutout 132 and the second ledge 126 includes a fourth cutout 134 that is aligned with the third cutout 132. The third and fourth cutouts 132, 134 are also aligned to allow a head 142 of a linking element 140 to pass between the third and fourth cutouts 132, 134, similar to the first and second cutouts 128, 130, thus allowing the attachment of the post structure 102 to an adjacent post structure 104.

Figure 10:
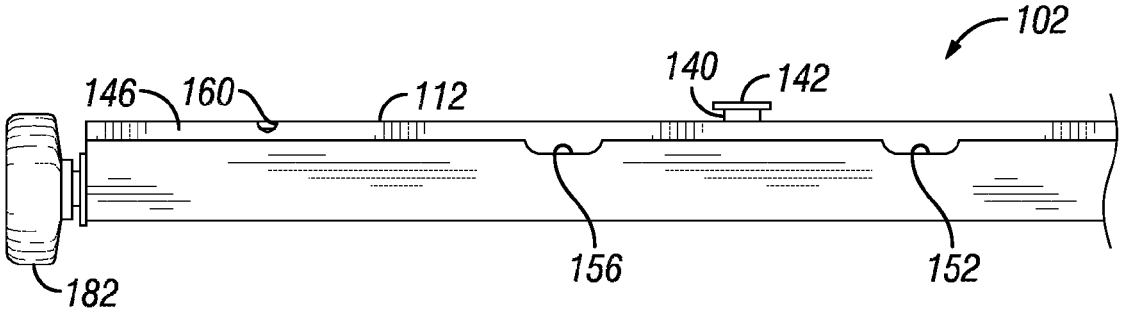
FIG. 10 is a magnified side view of a post structure including a linking element and a foot.
Figure 11:
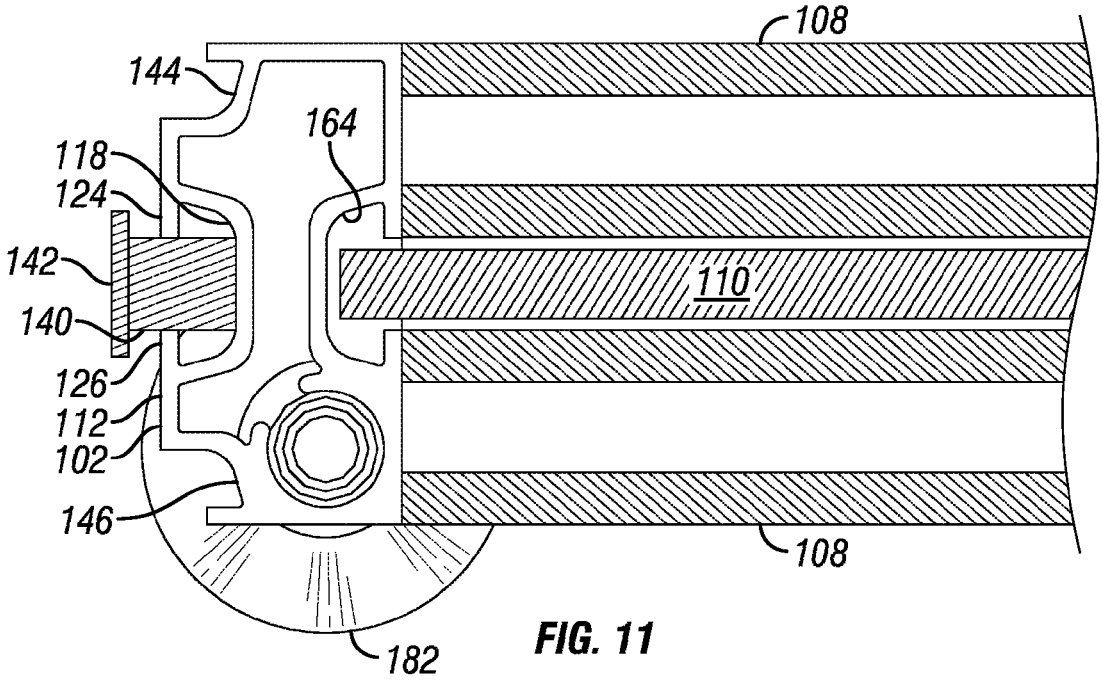
FIG. 11 is a magnified top view of the panel support of FIG. 1 including a linking element.

The embodiment of FIG. 4 also includes a linking opening 136 that is located in the central channel 118 between the first and second cutouts 128, 130 and the third and fourth cutouts 132, 134. The linking opening 136 is configured to removably and adjustably receive the linking element 140 (not shown in FIG. 4). As shown in FIGS. 10-11, the linking element 140 protrudes from a surface of the front side 112 of the post structure 102 so that the head 142 of the linking element 140 is exposed. The linking element 140 is adjustable in the linking opening 136 and is removably attached to the linking opening 136. The linking opening 136 may extend partially through the thickness of the material of the central channel 118 or may extend completely through the thickness of the material of the central channel 118.

As discussed above, the head 142 of the linking element 140 is sized to fit between a first cutout 128 and a second cutout 130 of a post structure 104 of an adjacent system 202 and to lock within a central channel 118 of the adjacent system 202, as shown in FIG. 22. Because the linking element 140 is removable from the linking opening 136, the front side 112 may function as a male attachment, in which the linking element 140 protrudes from the front side 112, as shown in FIGS. 10 and 11, or a female attachment, in which a linking element 140 is not attached to the linking opening 136 and the cutouts 128, 130, 132, 134 may receive the linking element 140 of an adjacent system 202, as shown in the embodiments of FIGS. 3-9.

Referring again to FIGS. 10 and 11, in some embodiments the linking element 140 is easily removable from the linking opening 136, such as, for example, by a threaded connection between the linking element 140 and the linking opening 136, so that the front side 112 of the post structure 102 can be changed from a male connection to a female connection, or vice versa, by a user without the need to search for designated male or female post structure 102. In addition, in some embodiments, the linking element 140 is insertable in and/or removable from the linking opening 136 by hand without the need for additional tools. For example, a perimeter of the head 142 may have a knurled surface for gripping by the user.

Figure 3:
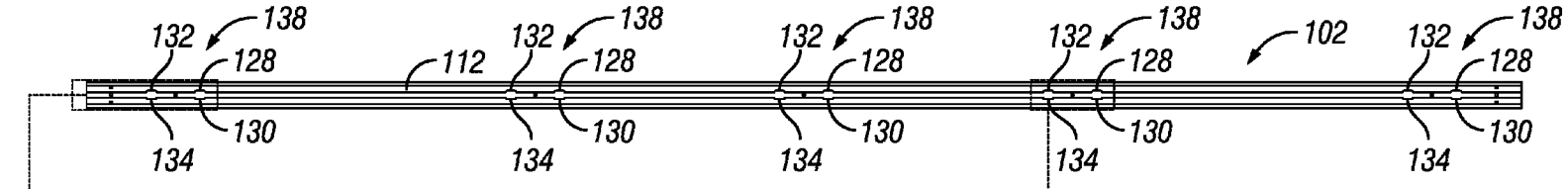
FIG. 3 is a front view of a post structure.

Referring now to FIG. 3, the first, second, third and fourth cutouts 128, 130, 132, 134 and the linking opening 136 together constitute an attachment group 138. In the embodiment shown in FIG. 3, for example, the post structure 102 includes five attachment groups 138 spaced along the post structure 102. In other embodiments, the post structure 102 may include any number of attachment groups 138. In addition, although the attachment groups 138 shown in the FIGURES include a first, second, third and fourth cutouts 128, 130, 132, 134, the attachment groups 138 may include other numbers and arrangements of cutouts. For example, in some embodiments, an attachment group 138 includes only the first and third cutouts 128, 132 in the first side of the central channel 118. In some embodiments, the attachment group 138 includes only the second and fourth cutouts 130, 134 in the second side of the central channel 118. In some embodiments, the attachment group 138 includes only a single cutout 128 in one side of the central channel 118. In yet other embodiments, the attachment group 138 includes only the first and second cutouts 128, 130. The attachment groups 138, and specifically, cutouts of the attachment groups 138, may be in any orientation that is configured to accept a head 142 of a linking element 140 of an adjacent panel system 202, as illustrated in the embodiment of FIG. 22.

In the embodiments shown in FIG. 3, the central channel 118 extends the entire length of the post structure 102. In some embodiments, however, the central channel 118 is contained within an attachment group 138 and extends only from a first end of the attachment group 138 to a second, opposite attachment group 138, or, in other words, from the first and second cutouts 128, 130 to the third and fourth cutouts 132, 134 (not shown). In some embodiments, the central channel 118 extends past one or more of the first and second ends of the attachment group 138 but does not extend the entire length of the post structure 102 (not shown).

Referring again to the embodiment shown in FIG. 4, the front side 112 of the post structure 102 also includes a first side channel 144 adjacent to the first side 120 of the central channel 118 and a second side channel 146 adjacent to the second side 122 of the central channel 118. The first side channel 144 includes an outer wall 148. The outer wall 148 includes a first outer wall cutout 150 that is aligned with the first cutout 128 and a third outer wall cutout 154 that is aligned with the third cutout 132.

The second side channel 146 also includes an outer wall 148. The outer wall 148 of the second side channel 146 includes a second outer wall cutout 152 that is aligned with the second cutout 130 and a fourth outer wall cutout 156 that is aligned with the fourth cutout 134. In some embodiments, one or more of the first, second, third and fourth outer wall cutouts 150, 152, 154, 156 are included in the attachment group 138.

As shown in the embodiment of FIG. 22, when two systems 200, 202 are connected together, the first and second outer wall cutouts 150, 152 are aligned and the third and fourth outer wall cutouts 154, 156 are aligned. The first and third outer wall cutouts 150, 154 of the first post structure 102 and the second and fourth outer wall cutouts 152, 156 of the second post structure 104 form a first lateral attachment group 194 that is similar to the attachment group 138. Thus, when two post structures 102, 104 are joined together with their front sides 112 touching, a third post structure 204 may be connected to the first lateral attachment group 194, as shown in the embodiment of FIGS. 23A and 23B.

Figure 23A:
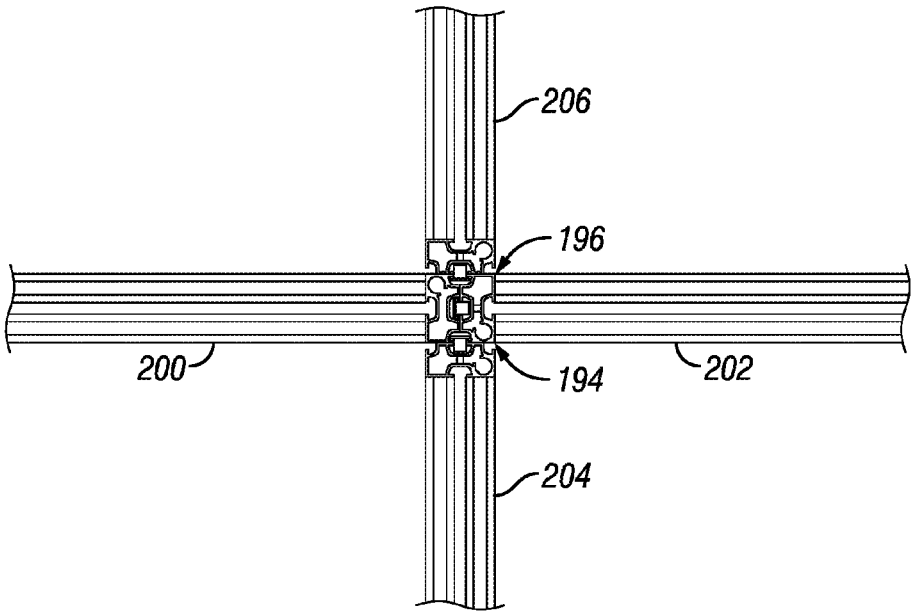
FIG. 23A is a top view of four interconnected panel support assemblies.
Figure 23B:
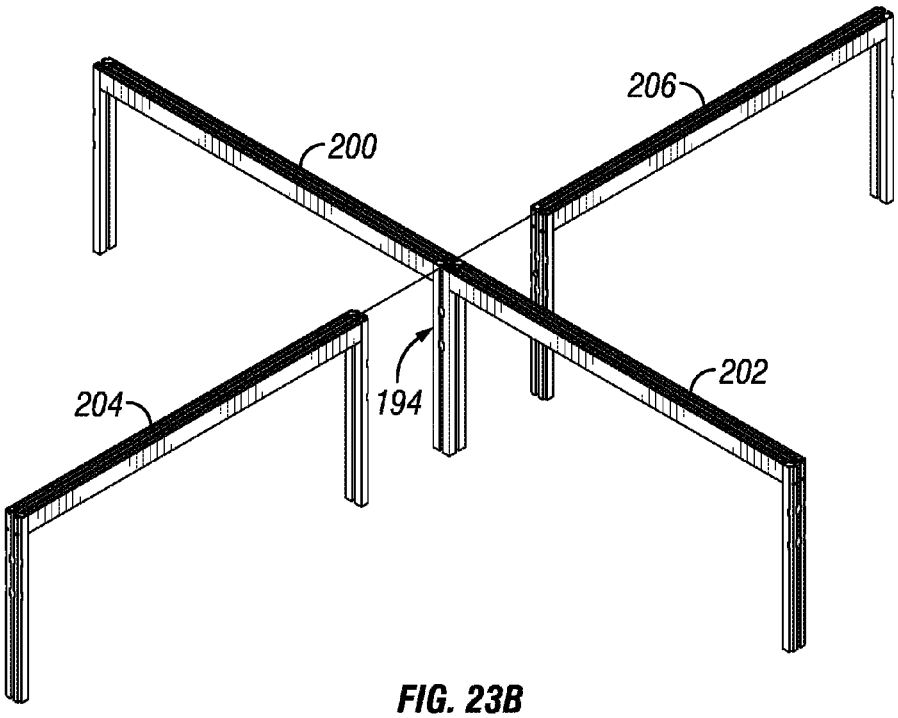
FIG. 23B is an exploded, perspective view of the four panel support assemblies of FIG. 23A.

Referring to FIGS. 22 and 23A, the second and fourth outer wall cutouts 152, 156 of the first post structure 102 of the first system 200 and the first and third outer wall cutouts 150, 154 of the second post structure 104 of the second system 202 form a second lateral attachment group 196 on an opposite side of the post structures 102, 104 from the first lateral attachment group 138. Thus, when two post structures 102, 104 are joined together with their front sides 112 touching, a fourth post structure 206 may be connected to the second lateral attachment group 196, opposite the first lateral attachment group 194.

Figure 5:
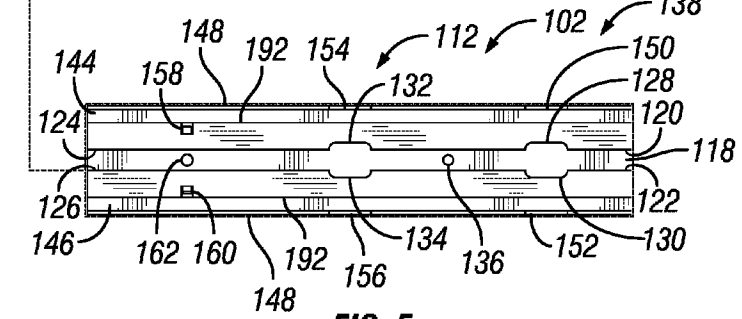
FIG. 5 is another magnified view of the post structure of FIG. 3.
Figure 6:
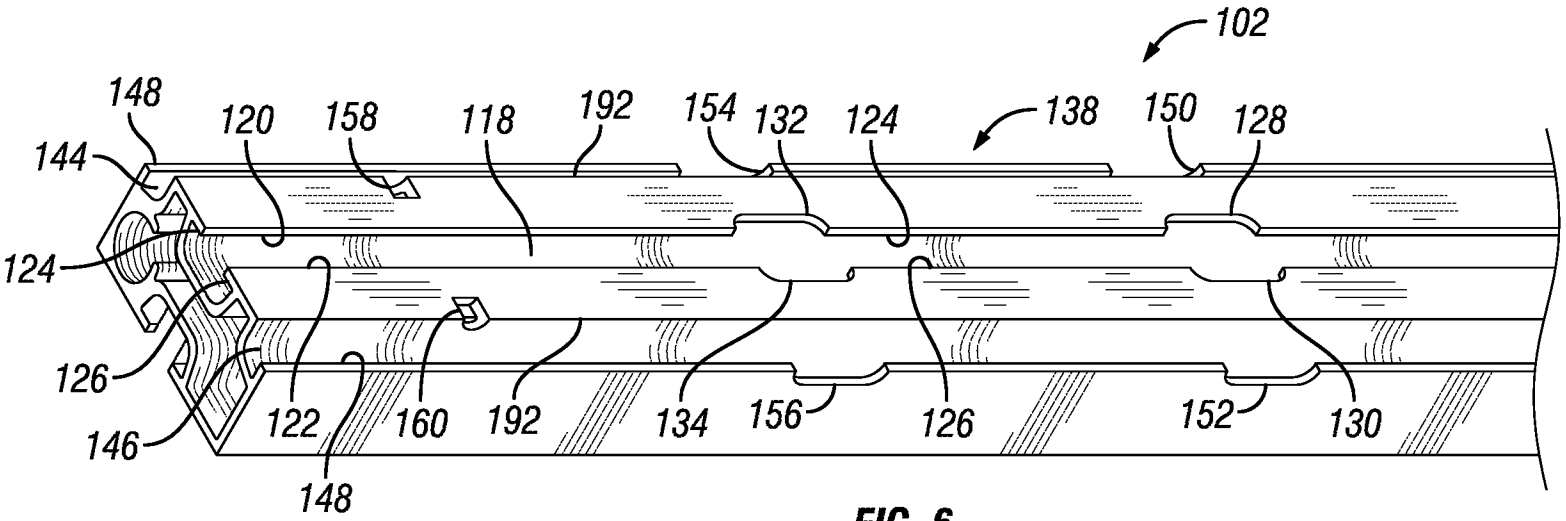
FIG. 6 is a magnified perspective view of the post structure of FIG. 3.

Referring now to FIG. 5, the first and second side channels 144, 146 also include inner walls 192. The inner wall 192 of the first side channel 144 includes a first inner wall cutout 158 and the inner wall 192 of the second side channel 146 includes a second inner wall cutout 160. The first inner wall cutout 158 is aligned with the second inner wall cutout 160. Referring now to FIG. 22, when two systems 200, 202 are joined with the front side 112 of the first system 200 contacting the front side 112 of the second system 202, the first inner wall cutout 158 aligns with the second inner wall cutout 160 to create an opening between the first and second systems 200, 202 that is configured to receive a slide bolt 172 of a third and fourth adjoining systems 204, 206, as will be discussed in more detail below.

Referring again to the embodiment shown in FIG. 5, the front side 112 also includes a slide bolt opening 162 adjacent to the first inner wall cutout 158 and the second inner wall cutout 160. As discussed in further detail below, the slide bolt opening 162 is configured to receive a slide bolt 172 from an adjacent system. For example, in the embodiment of FIG. 22, the slide bolt 172 of the first system 200 is received in the slide bolt opening 162 of the second system 202. The slide bolt 172 acts to stabilize the connection between the adjoining systems 200, 202 when it is in the slide bolt opening 162 of an adjacent system.

Referring now to the embodiment depicted in FIG. 13, the back side 114 of the post structure 102 includes a back side channel 164 and at least one accessory opening 166. The back side channel 164 is configured to slidably receive the panel 110 when the panel 110 is disposed between the first and second post structures 102, 104, as depicted in the embodiments of FIGS. 1 and 2. In conjunction with a first base channel 168, shown in the embodiment of FIG. 15, the back side channels 164 of the first and second post structures 102, 104 hold the panel 110 within the assembly 100. As shown in FIG. 14, the central channel 118 and the back side channel 164 are similar in shape and depth. In some embodiments, however, the central channel 118 and the back side channel 164 are dissimilar in shape and depth. In addition, although the central channel 118 and the back side channel 164 are generally in a center of the front and back sides 112, 114 of the post structure 102, the central channel 118 and the back side channel 164 may be by located off-center in some embodiments.

Referring now to FIG. 12, the accessory openings 166 are configured to hold elements, such as trays, shelving, garment racks, display bars and other custom attachments, between the accessory openings 166 of a first post structure 102 and the accessory openings 166 of a second post structure 104. The accessory openings 166 of the first post structure 102 and the accessory openings 166 of the second post structure 104 face each other when the post structures 102, 104 are connected as shown in the system 100 of FIG. 1. The accessory openings 166 of the first post structure 102 and the accessory openings 166 of the second post structure 104 face each other on a front side of the system 100, as shown in FIG. 1, and on a back side of the system 100 (not shown). As shown in FIG. 12, the accessory openings 166 are grouped into groupings of four accessory openings 166 and each grouping of four accessory openings 166 is spaced from other groupings of four accessory openings 166. The spacing between groupings of accessory openings 166 lowers the manufacturing cost associated with the post structure 102. In some embodiments, other numbers of accessory openings 166 may be grouped together and/or the individual accessory openings 166 may be equally spaced along the post structure 102. The accessory openings 166 may be openings transverse the back side 114 or indentations in the back side 114.

Figures 7, 8, 9:
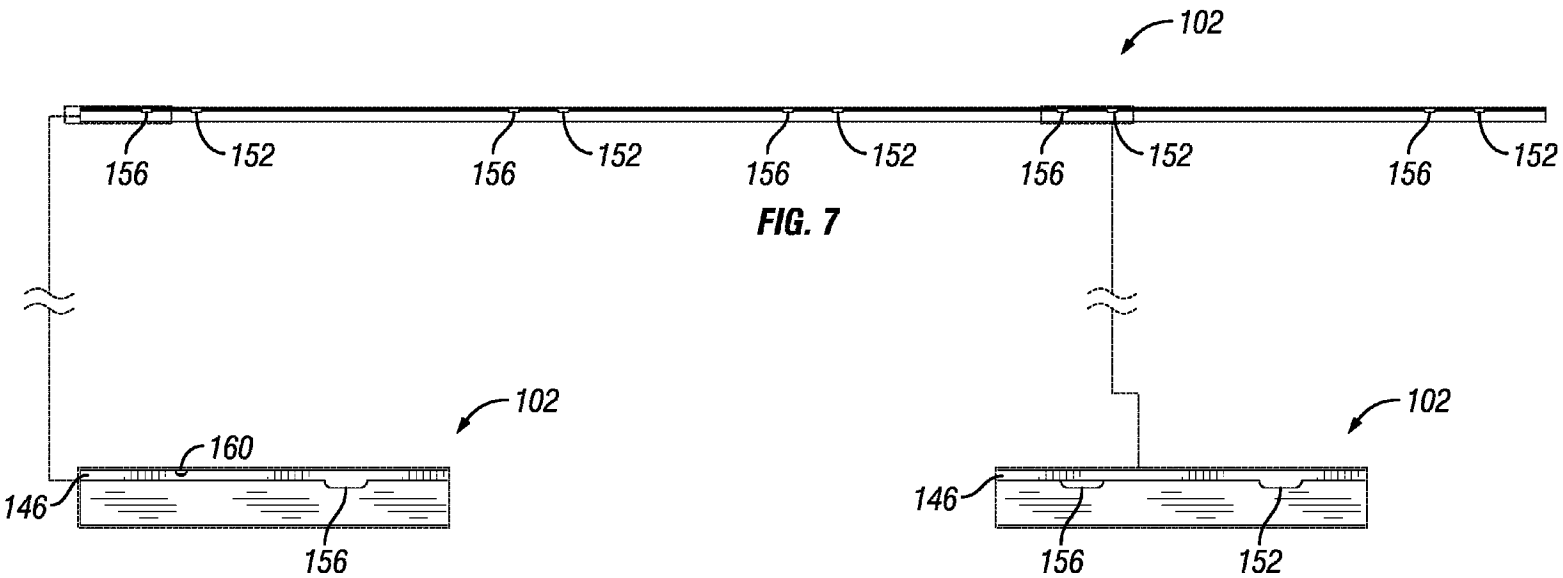
FIG. 7 is a side view of the post structure of FIG. 3.
FIG. 8 is a magnified view of the post structure of FIG. 7.
FIG. 9 is another magnified view of the post structure of FIG. 7.

As depicted in the embodiments of FIGS. 3, 7 and 12, the post structure 102 is generally symmetrical about a central lateral axis of the post structure 102. For example, the post structure 102 includes a first side inner wall cutout 158 and a second side inner wall cutout 160 near each lateral end of the post structure 102, as well as a symmetrical number and orientation of attachment groups 138. In addition, the post structure 102 is generally symmetrical about a central, perpendicular axis that is perpendicular to the central lateral axis of the post structure 102. In some embodiments, however, the post structure 102 is not symmetrical and corresponding, adjacent post structures are similarly non-symmetrical so that the post structures may be connected together.

Figure 15:
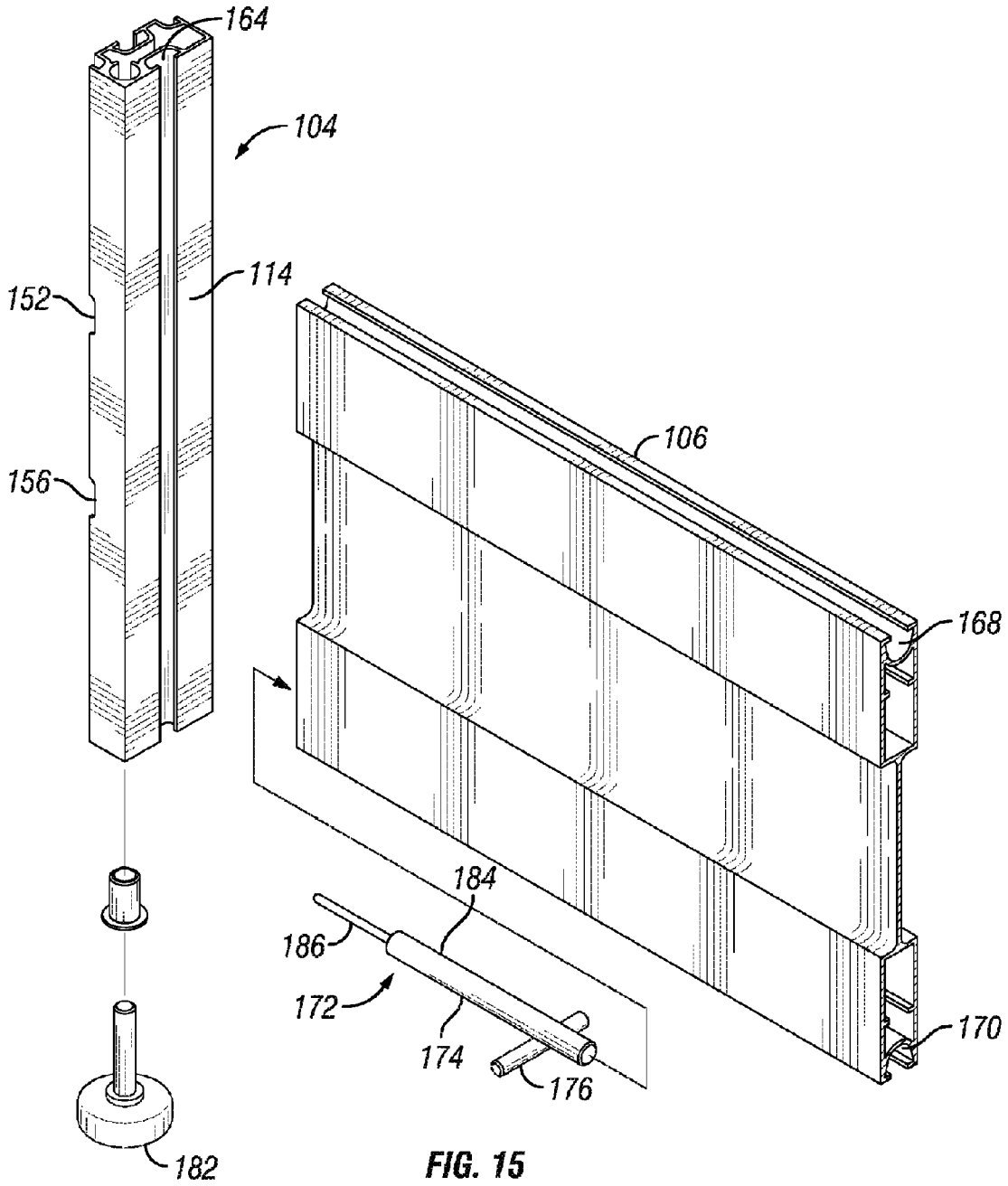
FIG. 15 is an exploded view of a base, a post structure, a foot and a slide bolt.

Referring again to the embodiment shown in FIG. 1, the base 106 is secured to the first and second post structures 102, 104. Referring to FIG. 15, the base 106 includes a first base channel 168 and a second base channel 170 on an opposite side of the base 106 from the first base channel 168. The base 106 may be permanently attached to the first and second post structures 102, 104 or removably attached to the first and second post structures 102, 104. The base 106 may be any suitable structure that includes the first and second base channels 168, 170. For example, in the embodiment of FIG. 15 the base 106 is a section of an extruded metal piece.

Referring to FIG. 15, the base 106 is secured to the back side 114 of the first and second post structures 102, 104 so that the first base channel 168 aligns with the back side channels 164 of the first and second post structures 102, 104. The first base channel 168 is configured to receive a portion of the panel 110 to help secure the panel 110 in the system 100. An opening of the first base channel 168 is sized to correspond to the width of the panel 110 so that a portion of the panel 110 rests within the first base channel 168 when the panel 110 is installed in the system 100.

Figure 17:
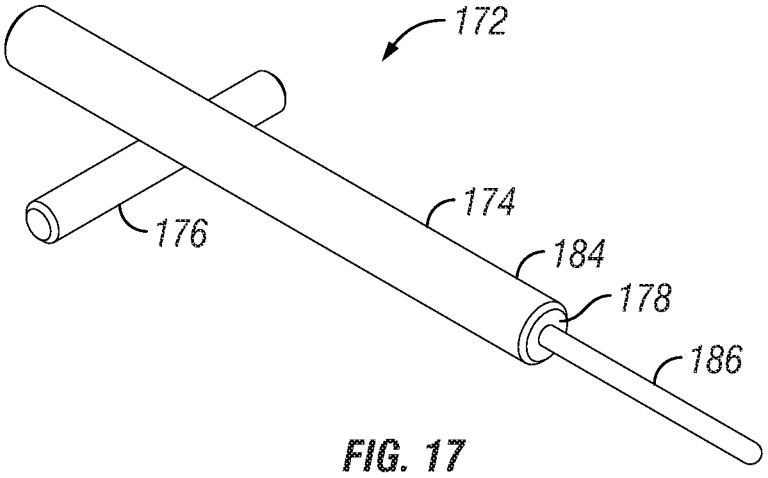
FIG. 17 is a perspective view of a slide bolt.
Figure 18:
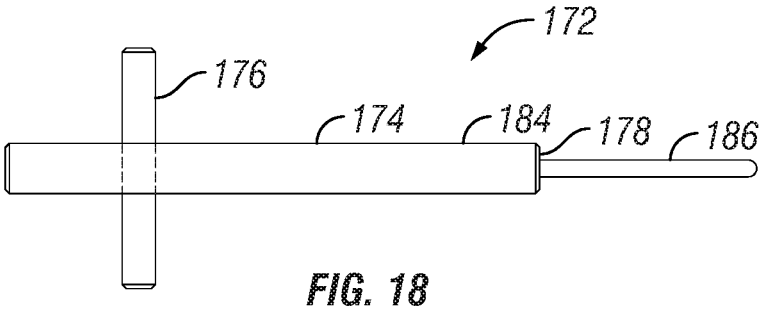
FIG. 18 is a top view of the slide bolt of FIG. 17.
Figure 19:
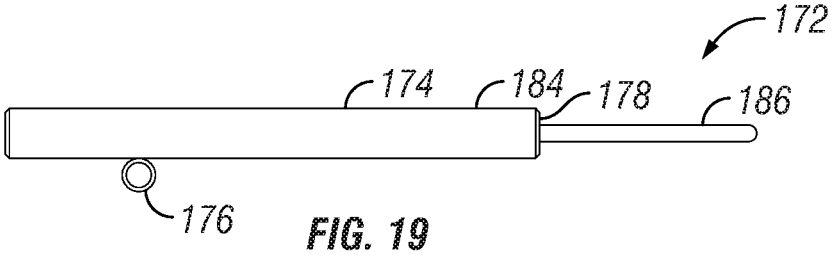
FIG. 19 is a side view of the slide bolt of FIG. 17.

The second base channel 170 is configured to receive a slide bolt 172. Referring specifically to the embodiments shown in FIGS. 17-19, the slide bolt 172 includes a first body member 174 designed to slidable engage the second base channel 170, and a second body member 176. The second body member 176 is attached to the first body member 174 so that the slide bolt 172 is generally formed in the shape of a lower case "t".

The first body member 174 includes a first portion 184 having a first cross-sectional shape and a second portion 186 having a second cross-sectional shape. The area of the first cross-sectional shape is larger than the area of the second cross-sectional shape such that a ledge 178 is formed at the intersection of the first portion 184 and the second portion 186. The cross sectional shape of the first portion 184 is shaped to slide within the second base channel 170 and the cross sectional shape of the second portion 186 is shaped to slide within the slide bolt opening 162, as shown in the embodiments of FIGS. 15, 16 and 22.

Figure 16:
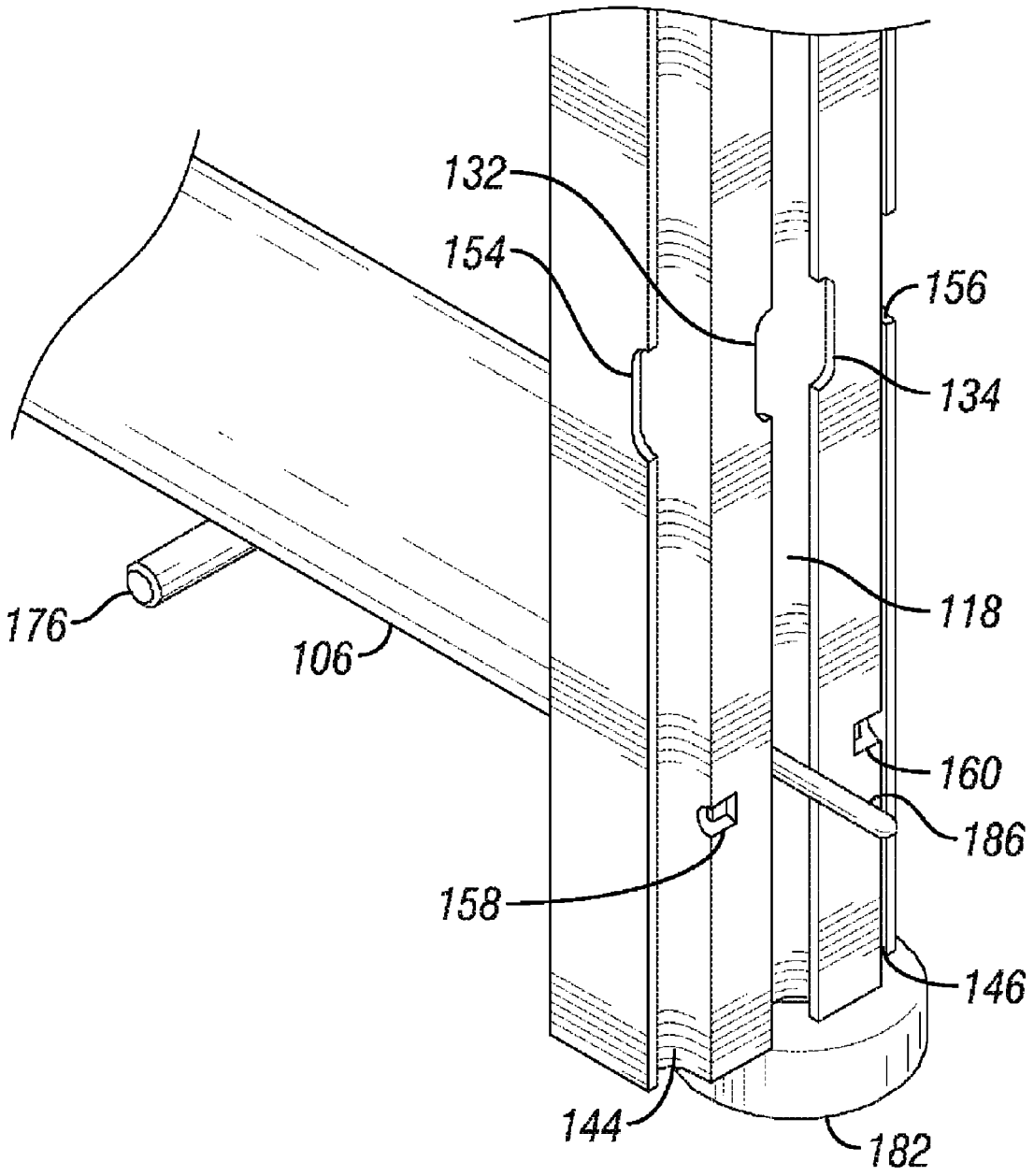
FIG. 16 is a magnified perspective view of a base, a post structure and a slide bolt in the extended position.

Referring to the embodiment of FIG. 16, the second body member 176 of the slide bolt 172 is configured to be positioned generally perpendicularly to the second base channel 170 when the first body member 174 is located in the second base channel 170. As such, the second body member 176 protrudes from both sides of the base 106 and is accessible to a user on both sides of the base 106. Thus, a user can move the slide bolt 172 into or out of the slide bolt opening 162 from both sides of the base 106, for example, using the user's foot.

Referring to FIG. 22, the slide bolt 172 stabilizes the connection between adjacent, interconnected systems 200, 202. In practice, the slide bolt 172 is in a retained position until two systems 200, 202 are connected. Once the systems 200, 202 are connected, the slide bolt 172 is moved toward the second system 202 so that the second portion 186 of the first body member 174 enters the slide bolt opening 162 of the second system 202. The ledge 178 contacts an inner lateral surface of the second base channel 170 when the slide bolt 172 has been completely inserted into the slide bolt 172 opening 162. As described above, the slide bolt 172 of a third system 204 may stabilize the connection of the third system 204 to the first two systems 200, 202 by entering the area between the first inner wall cutout 158 of the first system 200 and the second inner wall cutout 160 of the second system 202. A fourth system 206 may be similarly secured to the first and second systems 200, 202.

Figure 20:
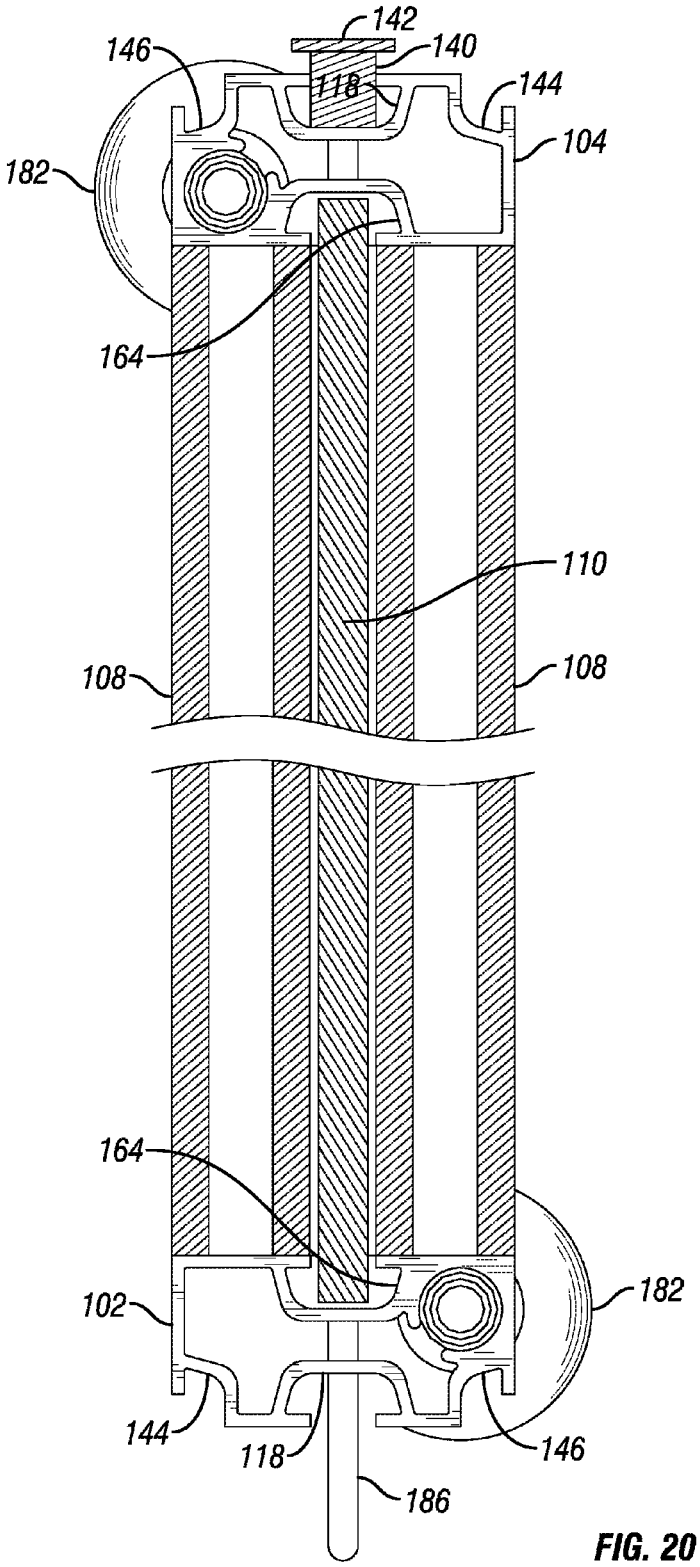
FIG. 20 is a top view of a panel support assembly including a linking element and a slide bolt.
Figure 21:
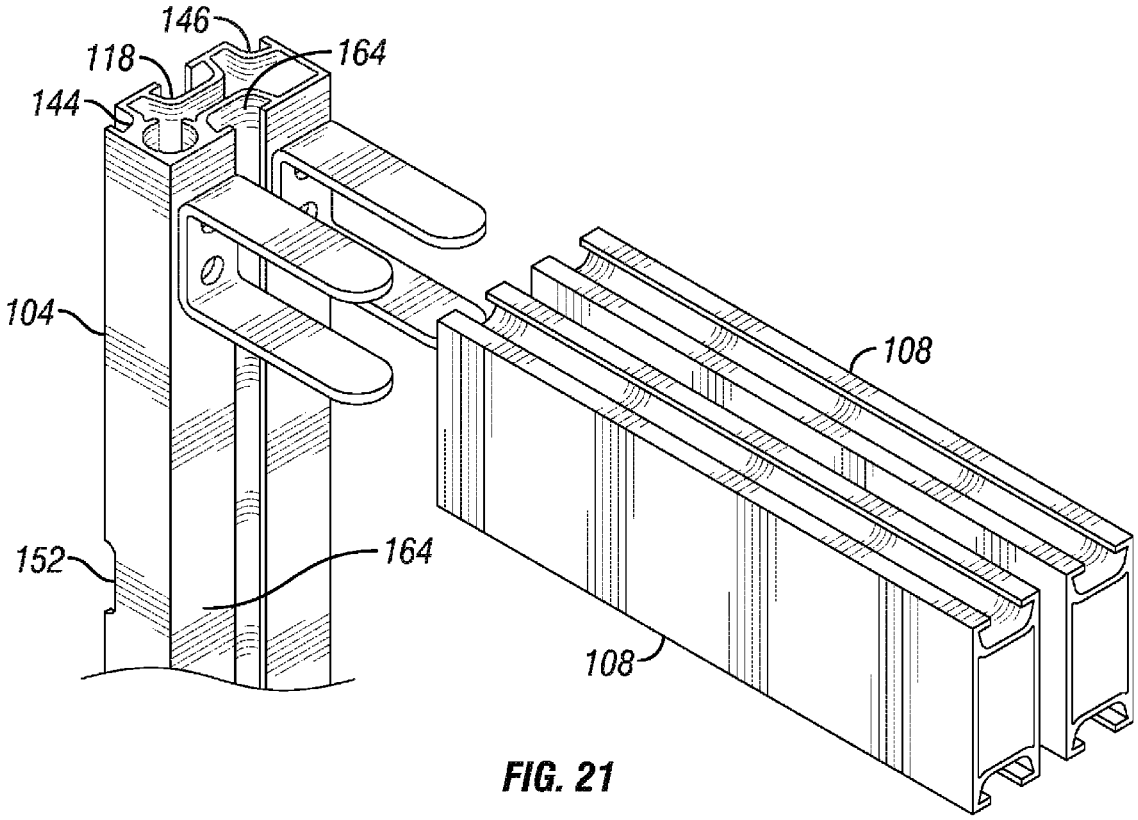
FIG. 21 is a magnified perspective view of a post structure and two connectors.

Referring again to FIG. 1, the first and second connectors 108 are connected to the first and second post structures 102, 104. Like the base 106, the first and second connectors 108 may be permanently attached to the first and second post structures 102, 104 or removably attached to the first and second post structures 102, 104. Referring to the embodiment shown in FIGS. 20 and 21, the first and second connectors 108 are spaced apart from each other by a distance corresponding to the thickness of the panel 110 so that the panel 110 can be inserted into the system 100 by placing the panel 110 between the first and second connectors 108.

The first post structure 102, second post structure 104, base 106 and connectors 108 may be made by extruding a material in the respective shapes of those parts. The material of the extrusion may be metal, plastic or any other suitable material. Long extrusions may be cut to the appropriate length to make the first post structure 102, second post structure 104, base 106 and connectors 108. The cutouts described herein may be made by removing material from the metal extrusions once the extrusions have been formed, for example, by use of a saw. In some embodiments, however, the first post structure 102, second post structure 104, base 106 and connectors 108 are made by molding into a shape that already includes any cutouts. Thus, in some embodiments, no extra material needs to be removed to create the cutouts. The openings described herein may be made by drilling, punching or any other suitable method.

In use, the system 100 may be supplied to a user in a completely assembled state, in which the base 106, first and second post structures 102, 104, and connectors 108 are already connected together as shown in FIG. 1, or the system 100 may be supplied disassembled. In some instances, the base 106, first and second post structures 102, 104, and connectors 108 are permanently connected together before being supplied to the user to prevent a user from disassembling the system 100. If necessary, the user assembles the system 100 by connecting lateral ends of the base 106 to the back sides 114 of the first and second post structures 102, 104 and connecting lateral ends of the connectors 108 to the back sides 114 of the first and second post structures 102, 104.

Once the system 100 is assembled, the user inserts the panel 110 between the first and second connectors 108 and between the first and second post structures 102, 104. The panel 110 slides within the back side channels 164 of the first and second post structures 102, 104 until the panel 110 contacts the first base channel 168. The system 100 is then placed in an upright position in which the connectors 108 are placed vertically over the base 106. The panel 110 is secured in the first base channel 168 and the back side channels 164 of the first and second post structures 102, 104 by the force of gravity acting on the panel 110. In some embodiments, the panel 110 may be further secured within the system 100 by some other mechanism, for example, by placing bolts between the connectors 108.

Adjacent systems 100 are then linked to the system 100 in order to create the desired layout. As depicted in the embodiment of FIG. 22, a first system 200 is linked to a second, adjacent system 202 to create a larger wall by locating the head 142 of the linking element 140 of the second system 202 between either the first and second cutouts 128, 130 of the first system 200 or the third and fourth cutouts 132, 134 of the first system 200. The head 142 of the linking element 140 of the second system 200 is then placed within the central channel 118 of the first system 200. The head 142 is then misaligned with the cutouts 128, 130, 132, 134 of the first system 200 and removably locked within the central channel 118 of the first system 200, as shown in FIG. 22.

A similar process is followed to lock a third and a fourth system 204, 206 to the first and second systems 200, 202, as shown in FIGS. 23A and 23B. Referring to FIG. 22, a lateral channel is formed by the first side channel 144 of the first system 200 and the second side channel 146 of the second system 202 when the front sides 112 of the first and second post structures 102, 104 contact each other. A lateral channel is also formed on the opposite side of the lateral channel described above by the first side channel 144 of the second system 202 and the second side channel 146 of the first system 200.

When the first and second systems 200, 202 are in the position shown in FIG. 22, the first and third outer wall cutouts 150, 154 of the first system 200 align with the second and fourth outer wall cutouts 152, 156 of the second system 202, respectively. As explained above, a space between the cutouts 150, 152, 154, 156 allows for passage of a head 142 of the linking element 140 of a third system 204. Once the head 142 of the linking element 140 of the third system 204 passes between the cutouts 150, 152, 154, 156, the head 142 is misaligned with the cutouts 150, 152, 154, 156 and locked within the lateral channel 198. The lateral channel formed by the first and second side channels 144, 146 is sized to retain a head 142 of a linking element 140.

Figure 24A:
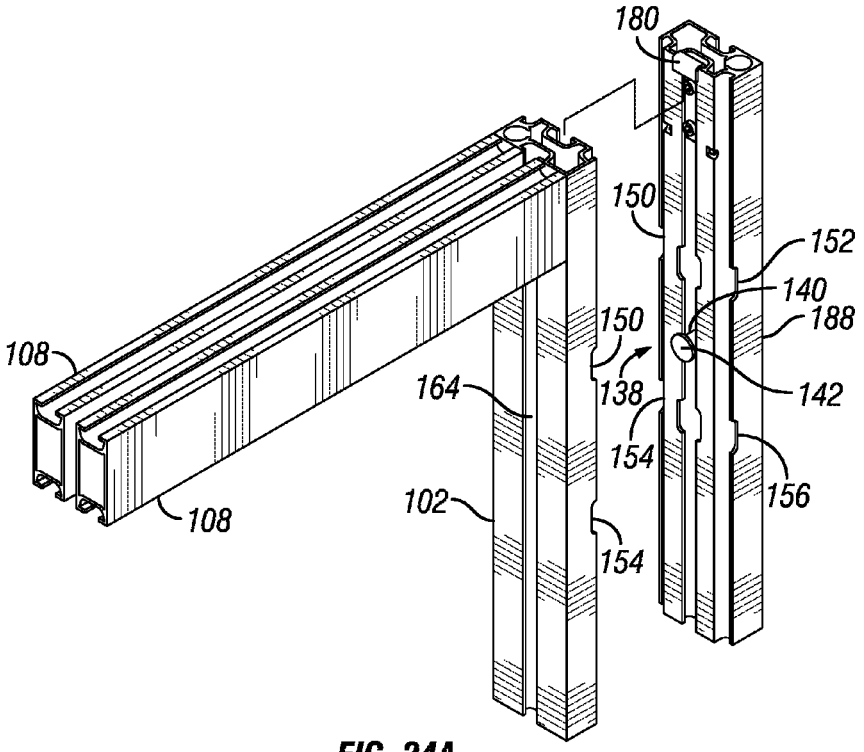
FIG. 24A is an exploded view of a post structure, two connectors and an end cap.
Figure 24B:
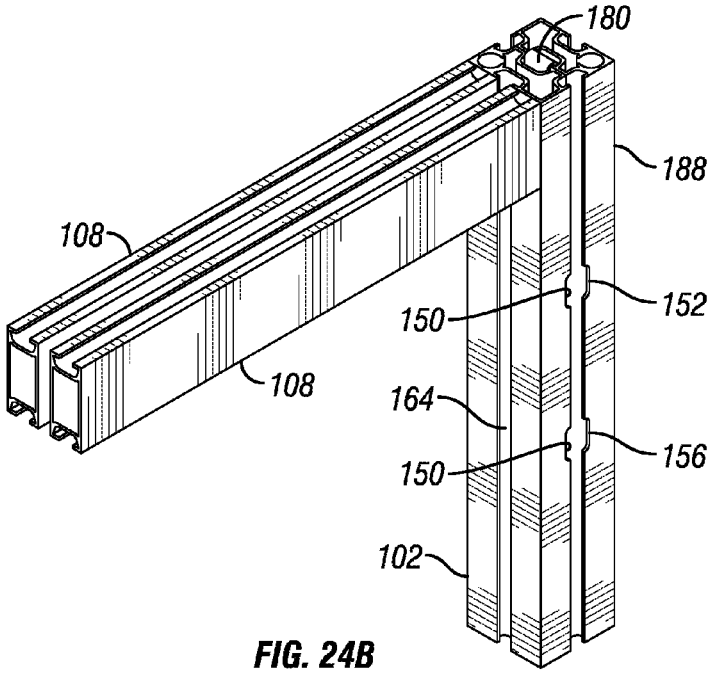
FIG. 24B is a perspective view of the post structure, two connectors and end cap of FIG. 24A, with the end cap attached to the post structure.

As shown in the embodiment of FIG. 24A, in some embodiments an end cap 188 may be connected to a post structure 102, for example, on an end of a row of systems 100 to create an aesthetically pleasing wall end. The end cap 188 is secured to the post structure 102 using attachment groups 138 and linking elements 136 in the manner described above. The end cap 188, however, does not include accessory openings 166 and need not include the back side channel 164 because the end cap 190 is configured to create an aesthetically pleasing end arrangement for the system 100. As shown in FIG. 24B, the end cap 188 may include a hook 180 on a lateral end of the end cap 188 to further secure the end cap 188 to the post structure 102.

Figure 25:
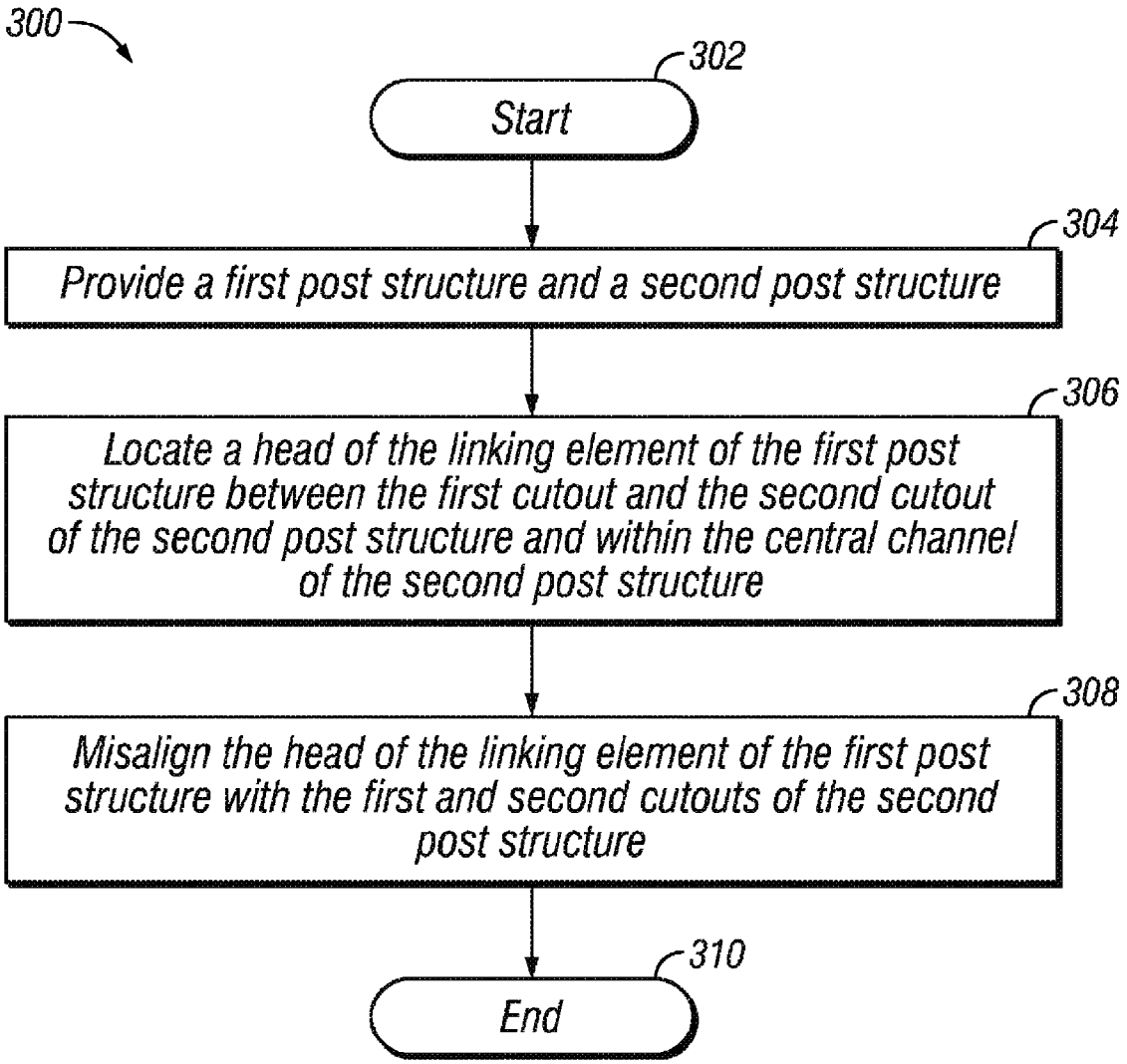
FIG. 25 is a schematic diagram showing a method of assembling a display unit.

FIG. 25 illustrates a method 300 for securing a first post structure 102 to a second post structure 104. The method begins at element 302 and a first post structure 102 and a second post structure 104 are provided at element 304. The first and second post structures 102, 104 include a front side 112 with a central channel 118 that includes a first cutout 128 in a first side of the channel 120 that is aligned with a second cutout 130 in a second side of the channel 122. The front side 112 of the first post structure 102 also includes a linking opening 136 in the central channel 118 and a linking element 140 connected to the linking opening 136.

At element 306 a head 142 of the linking element 140 of the first post structure 102 is located between the first cutout 128 and the second cutout 130 of the second post structure 104 and within the channel of the second post structure 104 at element 306. Then, the head 142 of the linking element 140 of the first post structure 102 is misaligned with the first and second cutouts 128, 130 of the second post structure 104 to lock the linking element 140 within the central channel 118 of the second post structure 104 and to lock the first post structure 102 to the second post structure 104 at element 308.

The method 300 may also include providing a first side channel 144 and a second side channel 146 in the first post structure 102 and the second post structure 104. The first side channel 144 includes a first outer wall 148 that includes a first outer wall cutout 150 aligned with the first cutout 128. The second side channel 146 includes a second outer wall 148 that includes a second outer wall cutout 152 aligned with the second cutout 130. A third post structure may be provided that includes a linking opening 136 and a linking element 140 connected to the linking opening 136. A head 142 of the linking element 140 of the third post structure may be located between the first outer wall cutout 150 of the first post structure 102 and the second outer wall cutout 152 of the second post structure 104. The head 142 of the linking element 140 of the third post structure may be misaligned with the first outer wall 148 cutout of the first post structure 102 and the second outer wall 148 cutout of the second post structure 104.

In some embodiments, the method 300 may also include securing a hook 180 to a lateral end of the third post structure and securing a foot 182 to a lateral end of at least one of the first post structure 102 and the second post structure 104.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and right", "front" and "rear", "above" and "below", "first" and "second", and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the invention(s), and alterations, modifications, additions and/or changes can be made thereto without departing from the scope and spirit of the disclosed embodiments, the embodiments being illustrative and not restrictive.

Furthermore, invention(s) have described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s). Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. A modular panel system, comprising:

a first post, a second post, and a third post, each post comprising:

a front face defining a central channel, the central channel comprising a floor having a linking opening, a first ledge extending from a first side of the central channel and a second ledge extending from a second side of the central channel, a first cutout in the first ledge, and a second cutout in the second ledge disposed aligned with the first cutout in the first ledge;

a rear face defining a panel receiving channel;

a first lateral face;

a second lateral face disposed opposite the first lateral face;

a panel having a lateral edge sized to be received by the panel receiving channel of either the first or the second post;

a first linking element and a second linking element, the first linking element having a head and being configured to be secured in the linking opening of the first post;

wherein the head of the first linking element is sized to fit within the first and second cutouts in the first and second ledges and to be secured by the first and second ledges of the second post to couple the first post to the second post; and wherein the first lateral face of the first post and either the first or the second lateral face of the second post together form a first side central channel and a first side central channel cutout to receive the second linking element to couple the third post to the coupled first and second posts.

2. The modular panel system of claim 1 further comprising a fourth post wherein the second lateral face of the first post and either the first or second lateral face of the second post together form a second side central channel and a second side central channel cutout to couple the fourth post to the coupled first and second posts.

3. The modular panel system of claim 1 wherein the first post is identical to the second post.

4. The modular panel system of claim 1 wherein each of the first and second posts have a length and the panel receiving channel extends substantially the length.

5. The modular panel system of claim 1 wherein the first linking element includes threads configured for threaded engagement with the linking opening.

6. The modular panel system of claim 1 wherein the first lateral face of the first post comprises an outer wall of the first side central channel and at least a portion of the first side central channel cutout is formed in the outer wall.

7. The modular panel system of claim 1 further comprising a fourth post wherein the second lateral face of the first post and either the first or second lateral face of the second post together form a second side central channel and a second side central channel cutout to couple the fourth post the coupled first and second posts, and wherein the second lateral face of the first post comprises an outer wall of the second side central channel and at least a portion of the second side central channel cutout is formed in the outer wall.

8. The modular panel system of claim 1, wherein each of the first and second posts further comprises a third cutout in the first ledge and a fourth cutout in the second ledge, wherein the third cutout is aligned with the fourth cutout and wherein the linking opening is disposed between the first and second cutouts and the third and fourth cutouts.

9. The modular panel system of claim 8, wherein the first, second, third and fourth cutouts and the linking opening comprise an attachment group, wherein each of the first and second posts comprises a plurality of the attachment groups.

10. The modular panel system of claim 8 wherein the first, second, third and fourth cutouts and the linking opening comprise an attachment group and the central channel extends from a first end of the attachment group to a second, opposite end of the attachment group.

11. The modular panel system of claim 10 wherein the central channel extends past at least one of the first and second ends of the attachment group.

12. The modular panel system of claim 1 wherein each of the first and second posts comprise a central lateral axis and a central perpendicular axis that is generally perpendicular to the central lateral axis, wherein each post is generally symmetrical about the central lateral axis and wherein each post is generally symmetrical about the central perpendicular axis.

13. The modular panel system of claim 1 wherein the rear face of each of the first and second posts further comprises a plurality of accessory openings.

14. The modular panel system of claim 13 wherein a first grouping of four accessory openings is spaced apart from a second grouping of four accessory openings.

15. The modular panel system of claim 1 further wherein each of the first and second posts comprises a slide bolt opening disposed in the central channel, wherein the slide bolt opening is configured to receive a slide bolt.

16. A modular panel system, comprising:

a first post, a second post, and a third post, each post comprising:

a front face defining a central channel, the central channel comprising a floor having a linking opening and a slide bolt opening, a first ledge extending from a first side of the central channel and a second ledge extending from a second side of the central channel, a first cutout in the first ledge, and a second cutout in the second ledge disposed aligned with the first cutout in the first ledge;

a rear face defining a panel receiving channel;

a first lateral face;

a second lateral face disposed opposite the first lateral face;

a panel having a lateral edge sized to be received by the panel receiving channel of either the first or the second post;

a first linking element and a second linking element, the first linking element having a head and being configured to be secured in the linking opening of the first post;

wherein the head of the first linking element is sized to fit within the first and second cutouts in the first and second ledges and to be secured by the first and second ledges of the second post to couple the first post to the second post;

wherein the first lateral face of the first post and either the first or the second lateral face of the second post together form a first side central channel and a first side central channel cutout to receive the second linking element to couple the third post to the coupled first and second posts;

a base coupled to either the first or the second post, the base having a slide bolt receiving channel; and a slide bolt having first portion received in the slide bolt receiving channel and a second portion received in the slide bolt opening in either the first or the second post.

17. The modular panel system of claim 16 further comprising a fourth post, wherein the second lateral face of the first post and either the first or second lateral face of the second post together form a second side central channel and a second side central channel cutout to couple the fourth post the coupled first and second posts.

* * * * *